United States Patent [19]

Bender

[11] Patent Number: 4,616,795

[45] Date of Patent: Oct. 14, 1986

[54] NURSING BOTTLE HOLDER

[76] Inventor: Larry J. Bender, 21 Shar-Denn Dr., Hampton, Iowa 50441

[21] Appl. No.: 722,510

[22] Filed: Apr. 12, 1985

[51] Int. Cl.[4] ..... A47D 15/00

[52] U.S. Cl. ..... 248/103; 248/105

[58] Field of Search ..... 248/102, 103, 104, 105, 248/106, 107, 309.1, 146, 154, 214, 122; 282, 283, 285, 289.1; 84/95 C, 94 C; D24/48

[56] References Cited

U.S. PATENT DOCUMENTS

| | | | |
|---|---|---|---|
| 743,914 | 11/1903 | McMurran | 248/106 |
| 1,082,808 | 12/1913 | Hubbard | 248/107 X |
| 1,220,266 | 3/1917 | Ott | 248/103 |
| 1,734,522 | 11/1929 | Kauffman | 248/103 |
| 1,737,468 | 11/1929 | McAnaney | 248/106 |
| 1,874,514 | 8/1932 | Hansen | 248/106 |
| 2,349,054 | 5/1944 | Phipps | 248/106 |
| 2,434,440 | 1/1948 | Schafranek | 248/106 UX |
| 2,542,694 | 2/1951 | Miller | 248/107 |
| 2,721,718 | 10/1955 | Wagner | 248/214 |
| 2,909,345 | 10/1959 | Matsuoka | 248/106 |
| 2,929,290 | 3/1960 | Smith | 248/105 UX |
| 3,519,231 | 7/1970 | Miller | 248/106 |
| 4,138,019 | 2/1979 | Smith | 248/214 X |
| 4,185,801 | 1/1980 | Plymouth | 248/289.1 |

FOREIGN PATENT DOCUMENTS

| | | | |
|---|---|---|---|
| 482220 | 9/1929 | Fed. Rep. of Germany | 248/285 |
| 190097 | 6/1937 | Switzerland | 248/282 |

*Primary Examiner*—J. Franklin Foss

*Attorney, Agent, or Firm*—David C. Larson

[57] ABSTRACT

A nursing bottle holder which is adaptable for use with a crib as well as a high chair, stroller, car seat or the like is provided. The preferred embodiment is an adjustable bottle holder which maintains the nursing bottle in the desired location and feeding angle while it keeps the infants attention through the incorporation of brightly colored beads, keeps the infant soothed through the incorporation of a music box, and serves as a storage receptical for bottles, pacifiers, diapers and other items frequently used in connection with infant feeding.

3 Claims, 4 Drawing Figures

NURSING BOTTLE HOLDER

BACKGROUND OF THE INVENTION

The present invention relates generally to infant feeding devices and more particularly to a multi-purpose nursing bottle holder adaptable to various infant holding structures.

Those concerned with the care and feeding of infants, are familiar with the time and attention required in bottle feeding an infant. Typically, when an infant becomes hungry, (s)he will fuss until (s)he is given a bottle of formula or milk to feed on and once the bottle is started, any interruptions in feeding, typically cause the infant to fuss even more energetically that the initial outburst. This can cause a particular problem in nurseries or the like where the attendant is caring for more than one infant and two infants become hungry at the same time or a second infant becomes hungry while the attendant is occupied with feeding a first infant. Also, a problem can arise in the home when the person feeding a hungry infant gets interrupted to attend to the phone, doorbell, oven timer, or any number of other matters in the home.

In the past, various configurations of bottle holder apparatuses have been developed which can hold a baby bottle. Although, in general, these devices have sufficed, they fail to adequately meet other needs an infant often has while feeding. Many times when an infant is having difficulty in feeding, it is helpful to attract his or her attention elsewhere to prevent him or her from grabbing or batting at the bottle. In the case of hand feeding, this is often accomplished by the feeder making silly faces or wearing brightly colored jewelry or hats, but to date, no bottle holders provide for keeping the infant's attention while feeding, and thus allowing the infant's natural instinct for receiving nourishment to take over. Additionally, it is often beneficial for soothing music to accompany feeding and calm the infant, especially when the child is upset or cranky. The prior art does not teach of a combination as disclosed in the present invention, but rather, in the past, a separate device such as a music box or the like was required, and often times there was no convenient place near the infant to place the music box so (s)he could hear it.

With the increase of infants in day care centers due to the increase in families with both spouses working, there is a need for feeding aids to assist the attendants in their care for infants. Also, with the many interruptions that can occur in a modern household, there is a need for a nursing bottle holder that can meet an infant's needs while the parent is attending to the interruption.

The disclosure of the present invention is not intended to advocate the replacement of personal attention during infant feeding, but in those instances where feeding might otherwise be delayed or interrupted, a device is needed which can act as a surrogate for the personal feeding.

SUMMARY OF THE INVENTION

Accordingly, the present invention provides a device for use with a crib, high chair, stroller, car seat or the like, which serves to sooth an infant as well as attract his or her attention in addition to holding a nursing bottle in an appropriate position for feeding.

An object of the present invention is to provide a device for holding a nursing bottle in an appropriate position and attitude for infant feeding.

Another object is to provide a nursing bottle holder that is adaptable to a crib or bassinet as well as an infant seat.

A further object of the invention is to provide a nursing bottle holder that also serves to sooth and calm an infant during feeding.

Still another object is to provide a nursing bottle holder that keeps an infant's attention and facilitates feeding.

Yet another object is to provide a nursing bottle holder that includes a storage pocket for holding infant accessories.

Other objects, advantages and novel features of the present invention will become apparent from the following detailed description of the invention, when considered in conjunction with the accompanying drawings.

BRIEF DESCRIPTIONS OF THE DRAWINGS

DESCRIPTION OF THE PREFERRED EMBODIMENT

Figure 1:
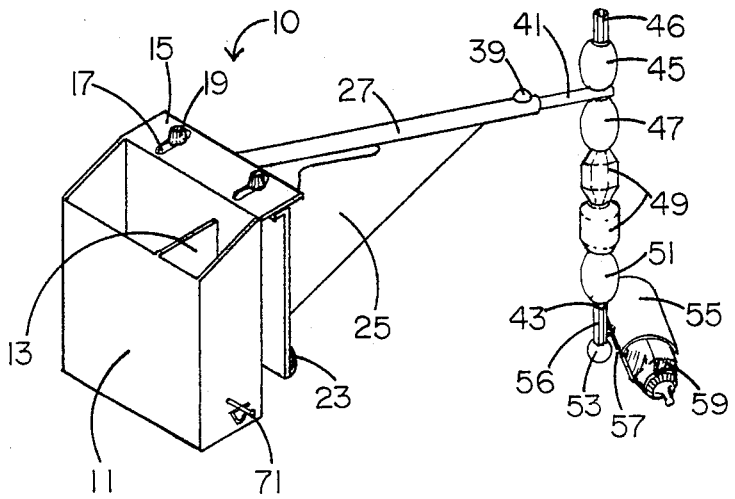
FIG. 1 is an isometric view of the present invention, showing the nursing bottle holder in the crib mode.

Referring now to the drawings wherein like reference numerals designate identical or corresponding parts throughout the several views, FIG. 1 shows the nursing bottle holder of the present invention indicated generally at 10. The bottle holder 10 attaches to the side of a crib by loosening a crib attachment nut 19 and sliding the bottle 10 over the side rail of a crib with crib plate 23 on the inside of the crib and storage container 11 on the outside of the crib. The crib plate 23 has two threaded fastners (not shown) designed to protrude up through elongated slots 17 located in top plate attachment 15 and engage nut 19. This allows the user to pinch the crib rail between plate 23 and container 11 and thereby stabalize the bottle holder 10 in the desired position by tightening nut 19.

The container 11 has a divider 13 separating it into two compartments. In the preferred embodiment the larger compartment is designed to hold three standard sized baby bottles upright while the smaller compartment is designed to hold miscellaneous accessories such as pacifiers or the like. Located within the bottom of the smaller compartment in a wind-up music box, which is operated by wind-up key 71. It is intended that the combined weight of the container 11, the music box (not shown) and the contents (not shown) stored in the container 11 will synergistically combine as a counterbalance to aid in stabilizing the bottle holder 10.

Figure 3:
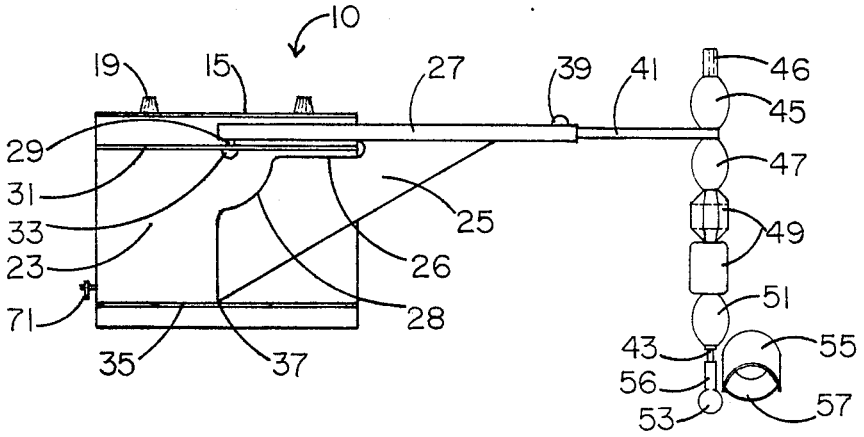
FIG. 3 is a side view of the crib mode.
Figure 4:
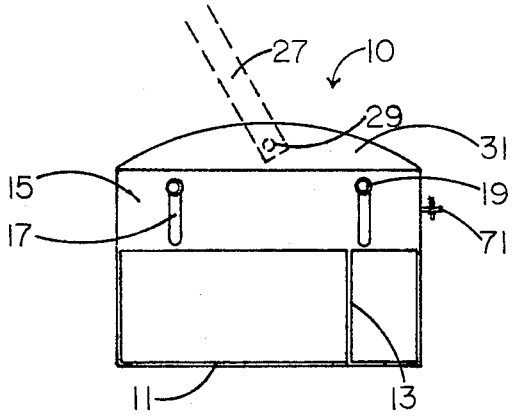
FIG. 4 is a top view of the crib mode.

The adjustable structure which serves to place and hold a bottle 59 in the desired position consists of a female telescoping member 27 which rotatably attaches to a support flange 31 affixed to the crib plate 23. A swivel pin 29 affixed in a downward attitude on female telescoping member 27 protrudes through an aperature in the support flange 31 and a swivel lock nut 33 can then be tightened to lock the female telescoping member 27 in the desired lateral direction. As can best be seen in FIG. 3, a webbing 25 is affixed to the bottom of the female telescoping member 27 with it's lower edge angling down to a peg (not shown) incorporated therein which rotatably cooperates with an aperature 37 located in a bottom flange 35 to complete the attachment to the portion of the bottle holder 10 which clamps onto the crib. On the upper perimeter of the webbing 25 there is a web groove 26 which allows the female telescoping member 27 to be swung out of the way and to the side when not in use without being prohibited therefrom by support flange 31. A web recess 28 serves to give the user's hand access to swivel lock nut 33.

A male telescoping member 41 slidably cooperates with female telescoping member 27 to adjust the lateral distance. When the desired distance is reached, a telescope lock nut 39 allows the position to be locked in.

There is an aperature located near the outer end of male telescoping member 41 which slidably accomodates a threaded rod 43. By turning a first top adjusting bead 45 in cooperation with a second top adjusting bead 47, the vertical position of the threaded rod can be adjusted and locked. In the preferred embodiment, the adjusting beads 45 and 47 are threaded the full axial length of their interiors, but a shorter thread distance would also be acceptable. A cap 46 covers the top of threaded rod 43, but it is not an essential element functionally.

Middle beads 49 are not threaded, but serve to cover threaded rod 43 and provide attention-getting shape and color for the infant. A bottom bead 51 is threaded in the same manner as beads 45 and 47 and functions to friction lock against a sleeve 56 when tightened. A semi-circular bottle holder 55 is affixed to sleeve 56 at an angle of approximately 45° in relation to the sleeve 56 and cooperates with an elastic strap 57 to hold the bottle 59 firmly in place. The sleeve 56 is prohibited from slipping off the bottom of the threaded rod 43 by bottom cap 53 which is removably attached to the bottom end of threaded rod 43.

In practice, the bottle holder 10 is placed over the rail of a crib and crib attachment nuts 19 are tightened to hold the aparatus firmly in place. Next, bottles or other desired items can be placed in the storage container 11 if desired and then the female telescoping member can be swung out to the desired direction. The swivel lock nut 33 is then tightened to restrict further movement and male telescoping member 41 is then adjusted is then adjusted to the desired length and locked with telescope lock nut 39. It is disclosed that prior to locking the male telescoping member 41 it can also be rotated axially to obtain the desired angle of the bottle 59. Next, the threaded rod 43, and thus the bottle 59, is raised or lowered by adjusting the top adjusting beads 45 and 47. Before friction locking the threaded rod 43, it can be rotated axially to point the bottle 59 in the desired direction. An alternate method of rotating the bottle 59 is to rotate sleeve 56 around the threaded rod 43 and then lock it in place with bottom adjusting bead 51. At this point, the infant is ready to be fed and the music box can be turned on by key 71 if desired.

Figure 2:
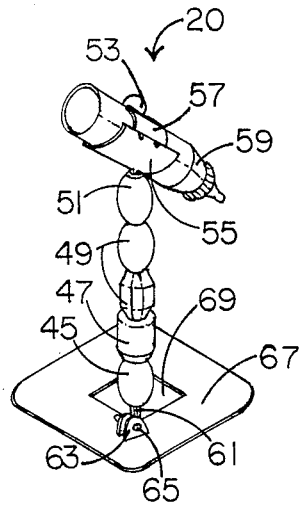
FIG. 2 is an isometric view of the nursing bottle holder in the infant seat mode.

As can best be seen in FIG. 2 the nursing bottle holder can best be adapted to the infant seat mode indicated generally at 20 by removing the cap 46, removing bead 45 and sliding the threaded rod 43 out of the male telescoping member 41. After replacing bead 45 the threaded rod 43 is inverted and rotatably attached onto a base plate 67 by inserting it into a receptacle 61. Once the desired angle between the threaded rod 43 and the base place 67 is set, it can be locked into place by tightening bolt 65 which is inserted in clevis 63 and through receptacle 61.

In use, the base plate 67 is placed flat on the seat of a carseat, high chair, stroller or the like, and the infant is seated on top of the base plate 67. The base plate 67 should be sufficiently thin to avoid causing discomfort to the child. Next, the verticle angle of the bottle holder 20 is set and locked and then the bottle 55 can be rotated to the desired position and friction locked with bead 51 in the same manner as in the crib mode 10. In order to better adjust the height, the rounded bottom cap 53 can be removed and replaced with cap 46 which is capable of greater axial movement. Should the bottle need to be significantly lowered, one of the non-threaded beads 49 can be removed and placed above the sleeve 56 and below cap 46.

The base plate 67 is provided with an aperature 69 for use with infant car seats, many of which have seat belt straps extending up through the middle of the seat.

The preferred embodiment is constructed of a lightweight, durable molded plastic with all threaded parts being formed from mylon, but it is understood that any non-brittle, non-deforming material will also work.

I claim:

1. A nursing bottle holder which is adaptable to a crib or infant seat comprising:

a container for temporary storage of infant feeding accessories;

a crib plate adjustably attached to the container for clamping the nursing bottle holder to the side of the crib;

a support flange affixed to the crib plate;

a bottom flange affixed to the crib plate;

a horizontally extending cylindrical telescoping arm pivotally attached to the support flange;

a webbing affixed to the lower side of the telescoping arm and pivotally attached to the bottom flange;

a swivel lock nut for locking the telescoping arm in a desired direction;

a telescope lock nut for locking the telescoping arm at a desired extension and in the desired rotation;

a cylindrical threaded rod slidably mounted near the outer end of the telescoping arm in a plane perpendicular to the axis of the telescoping arm;

first and second adjusting beads with threaded interiors for locking the threaded rod onto the telescoping arm;

a sleeve slidably and rotatably encasing the threaded rod;

a bottom cap removably attached to the bottom of the threaded rod to prevent the sleeve from sliding off;

a third adjusting bead with a threaded interior for friction locking the sleeve between the bottom cap and the third adjusting bead;

a concave planer arc affixed to the sleeve and approximating the shape of a nursing bottle and with a circumference arcing through at least ninety degrees; and an elastic strap cooperatively attached to the planer arc for holding the nursing bottle in place.

2. A nursing bottle holder as recited in claim 1 furthere comprising:

a wind-up music box located within the bottom of the container.

3. A nursing bottle holder comprising:

a generally square base plate for placement on the infant seat between the seat and the infant:

a clevis affixed to the base plate near one of the corners thereof;

a cylindrical receptacle adjustable attached within the clevis for receiving an elongated threaded rod;

a tightening bolt inserted in the clevis and through the receptacle for locking the cylindrical receptacle in the desired position;

a cylindrical threaded rod for insertion into the cylindrical receptacle;

a sleeve slidable and rotatably incasing the threaded rod;

a plurality of adjusting beads for holding the sleeve up on the cylindrical rod a predetermined desired distance;

a cap removably attached to the top of the elongated threaded rod to prevent the sleeve from sliding off the top;

a concave planer arc affixed to the sleeve and approximating the shape of a nursing bottle and with a circumference arcing through at least 90 degrees; and an elastic strap cooperatively attached to the planer arc for holding the nursing bottle in place.

* * * * *